United States Patent [19]

Lang et al.

[11] 4,221,102

[45] Sep. 9, 1980

[54] APPARATUS FOR SEALING CANS WITH LIDS UNDER VACUUM

[75] Inventors: Hans-Jörg Lang, Biberach; Ernst Schwerdtel, Munich, both of Fed. Rep. of Germany

[73] Assignee: Ludwig Schwerdtel GmbH, Karlsfeld, Fed. Rep. of Germany

[21] Appl. No.: 55,037

[22] Filed: Jul. 2, 1979

[51] Int. Cl.[3] ..... B65B 31/02

[52] U.S. Cl. ..... 53/96; 53/101

[58] Field of Search ..... 53/86, 89, 91, 94, 95, 53/96, 97, 101, 109

[56] References Cited

U.S. PATENT DOCUMENTS

| | | | |
|---|---|---|---|
| 1,279,413 | 9/1918 | Norton | 53/86 |
| 3,191,354 | 6/1965 | McElroy et al. | 53/96 |
| 4,154,044 | 5/1979 | Lang | 53/97 |

FOREIGN PATENT DOCUMENTS

| | | |
|---|---|---|
| 2263362 | 7/1974 | Fed. Rep. of Germany . |
| 2317517 | 10/1974 | Fed. Rep. of Germany . |
| 1457769 | 12/1976 | United Kingdom . |

*Primary Examiner*—Travis S. McGehee

*Attorney, Agent, or Firm*—Browdy and Neimark

[57] ABSTRACT

In an apparatus for sealing cans 7, 7' each having a lid 8, 8' under vacuum, a lifting device is provided having a plate 13, 33 movable from below against a stationary, evacuatable bell 14, 36 and serving to receive a can 7, 7' already provided with a lid 8, 8'. Devices for lifting the lid 8, 8' from the can 7, 7' are furthermore provided. In order to be able in addition to seal cans of different sizes in this apparatus, without having to change the course of operation of the apparatus, an adjustment piston 20 is provided as the device for lifting the lid 8, 8' from the can 7, 7', the adjustment piston being capable of being subjected to pressure medium and being guided in an adjustment cylinder 18. Reduction elements 52, 53 are furthermore releasably disposable on the adjustment piston 20 on the one hand, and on the inner wall of the bell 14 on the other.

5 Claims, 5 Drawing Figures

APPARATUS FOR SEALING CANS WITH LIDS UNDER VACUUM

FIELD OF THE INVENTION

The present invention relates to an apparatus for sealing lids to cans and, more particularly, to such an apparatus in which a partial vacuum is drawn in the can, the lid being held in place by atmospheric pressure, prior to crimping of the lid to the can.

BACKGROUND OF THE INVENTION

Apparatus related to that of the present invention is described in U.S. Pat. No. 4,154,044. This patent describes apparatus for sealing cans comprising a lifting mechanism associated with a lifting plate; a closing plate spaced below and in spring biased cooperation with such lifting plate which can be moved in a sealed manner against the lower rim of a vacuum bell; and apparatus for lifting the lid of a can on such lifting plate mounted in the upper portion of such vacuum bell. Such lifting apparatus comprises a plate with a permanent magnet supported within the vacuum bell in a spring biased manner.

In operation the lifting device moves the lifting plate upward until the lid of the can engages the permanent magnet and the closing plate seals the vacuum bell closed. The lifting plate with the can is then lowered slightly with the vacuum bell remaining tightly closed and the lid engaged to the magnet. Air is then evacuated and, as needed, partially filled with protective gas. Following these acts, the lifting plate with the can is moved upward once again, until the lid contacts the can. The can is then pressed upward by the lifting mechanism compressing the rim of the lid into sealed engagement with such can. The vacuum bell is then filled with air and the lifting plate with the sealed can moved downward completing the operation. This apparatus has proved itself excellent as a semi-automatic apparatus; however, it is unsuitable for attaining extremely high outputs on the one hand, and for use when the cans are of various sizes on the other.

An apparatus of this kind, known from German Offenlegungsschrift (laid open patent application) No. 2,317,517 is provided with a total of three lifting devices designed as pneumatically chargeable lifting cylinders, one of which actuates a lower vacuum bell, a second actuates an upper vacuum bell, and a third actuates the pressure plate of a sealing apparatus. The operation is such that a can, provided with a lid is placed in a lower plate-shaped recess after the lower vacuum bell has descended, after which the lower vacuum bell is moved upward and the upper vacuum bell is moved downward until the vacuum chamber is enclosed. Then the pressure plate, provided with a permanent magnet, a pneumatically acting sucker or the like, moves against the cover and then returns, leaving the lid adhering to the pressure plate. Then the vacuum chamber is evacuated, after which the lid is pressed onto the can by means of the pressure plate. Then air is admitted to the vacuum chamber again and the two vacuum bells move apart, upward and downward, respectively.

Although this known apparatus operates well in theory, it has the significant disadvantage that a considerable amount of effort is required for the three lifting devices and the switches required to control them, this effort being justified only for fully automatic apparatus having a high efficiency which operates under a continuously full load. Furthermore, this apparatus is not suitable for being converted at low cost for use with cans of different sizes.

SUMMARY OF THE INVENTION

It is the principal object of the present invention to improve on the apparatus described in the prior art in a manner permitting cans of different sizes to be sealed without making substantial structural changes to the sealing apparatus.

It is a further objective of this invention to speed the operation of sealing lids to the tops of cans.

These and other objects are attained through this invention by providing apparatus wherein the individual operational steps and the lifting distances of the lifting devices need no change when cans of different sizes, such as 2.5 kg cans and 1 kg cans are to be sealed.

These objectives are further accomplished by providing separate apparatus for air evacuation and, as needed, the refilling with gas on the one hand and apparatus for sealing the can after evacuation on the other. In addition, the objects are attained by providing lifting devices having relatively large lifting distances but small lifting force and thus high lifting velocity in the air evacuation station of the apparatus, while providing lifting devices having a small lifting distance but very great lifting force and accordingly low lifting velocity in the sealing station of the apparatus. Thus, in this manner, it is possible to attain approximately identical times in completing the function for both the vacuum station and for the sealing station apparatus, which contributes to increasing the operational speed of the entire process.

The objects of the invention are further accomplished by a sealing station which can be adapted, within given limits of tolerance, to different lid diameters. Small variations in lid diameter are encountered in any selected lot. However, as a result of the described apparatus, it is assured that even with such variable lid diameters within a given lot, a uniformly tight and secure sealing of the can is attained in every case.

In addition, an entirely uniform sealing of the cans by means of precise central orientation of the lid and the can is obtained by means of the present invention.

Further evacuation apparatus is described which will assure that the lid and the can are oriented as precisely as possible to one another during the evacuation and possible gas refilling process.

Further advantages and features of the invention will be apparent from the description of a preferred embodiment with the aid of the drawings.

DETAILED DESCRIPTION OF A PREFERRED EMBODIMENT

Figure 1:
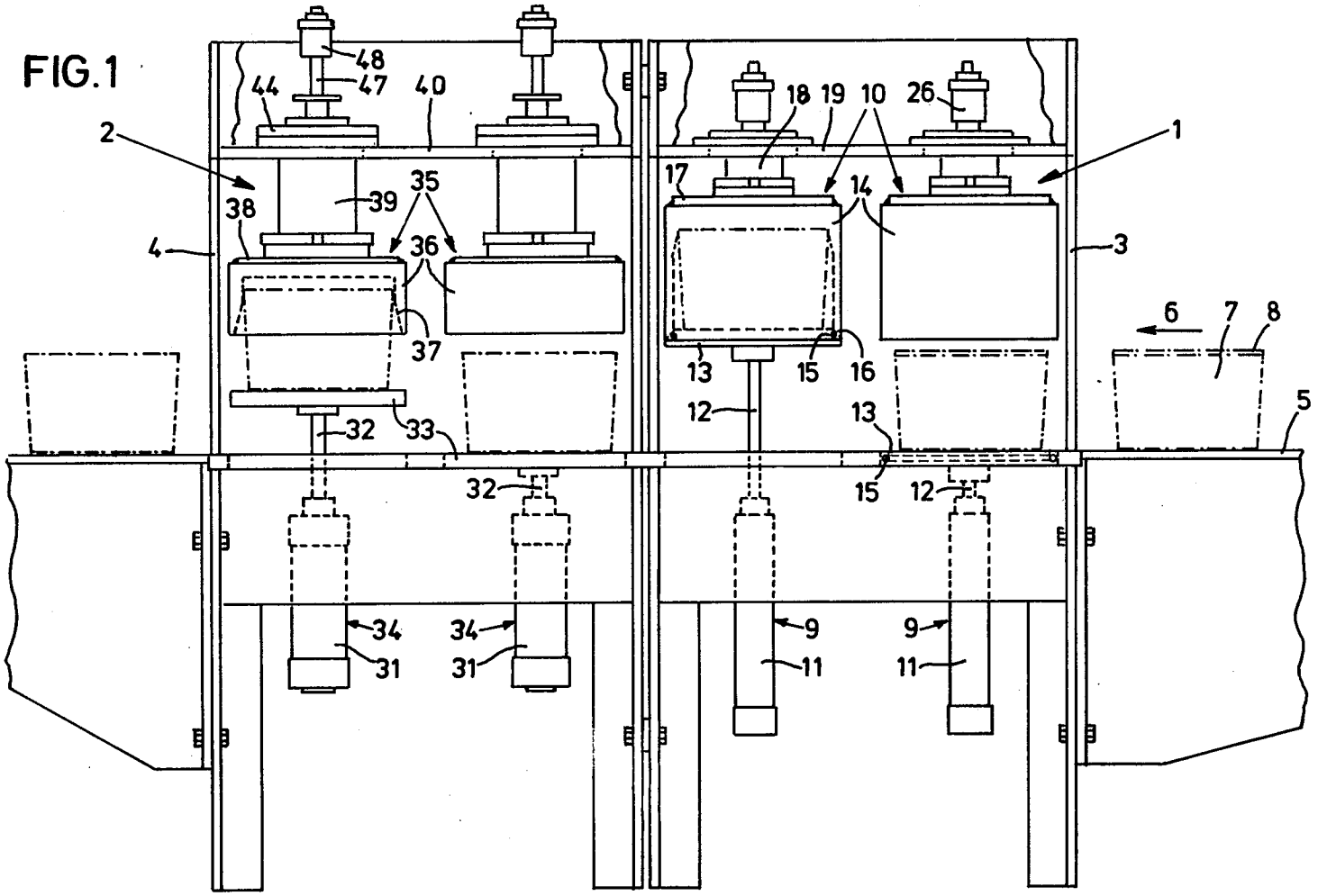
FIG. 1 is a somewhat diagrammatic, elevational view, partially in section, of an apparatus for sealing cans with lids according to the present invention showing both the air evacuation station and sealing station.
Figure 2:
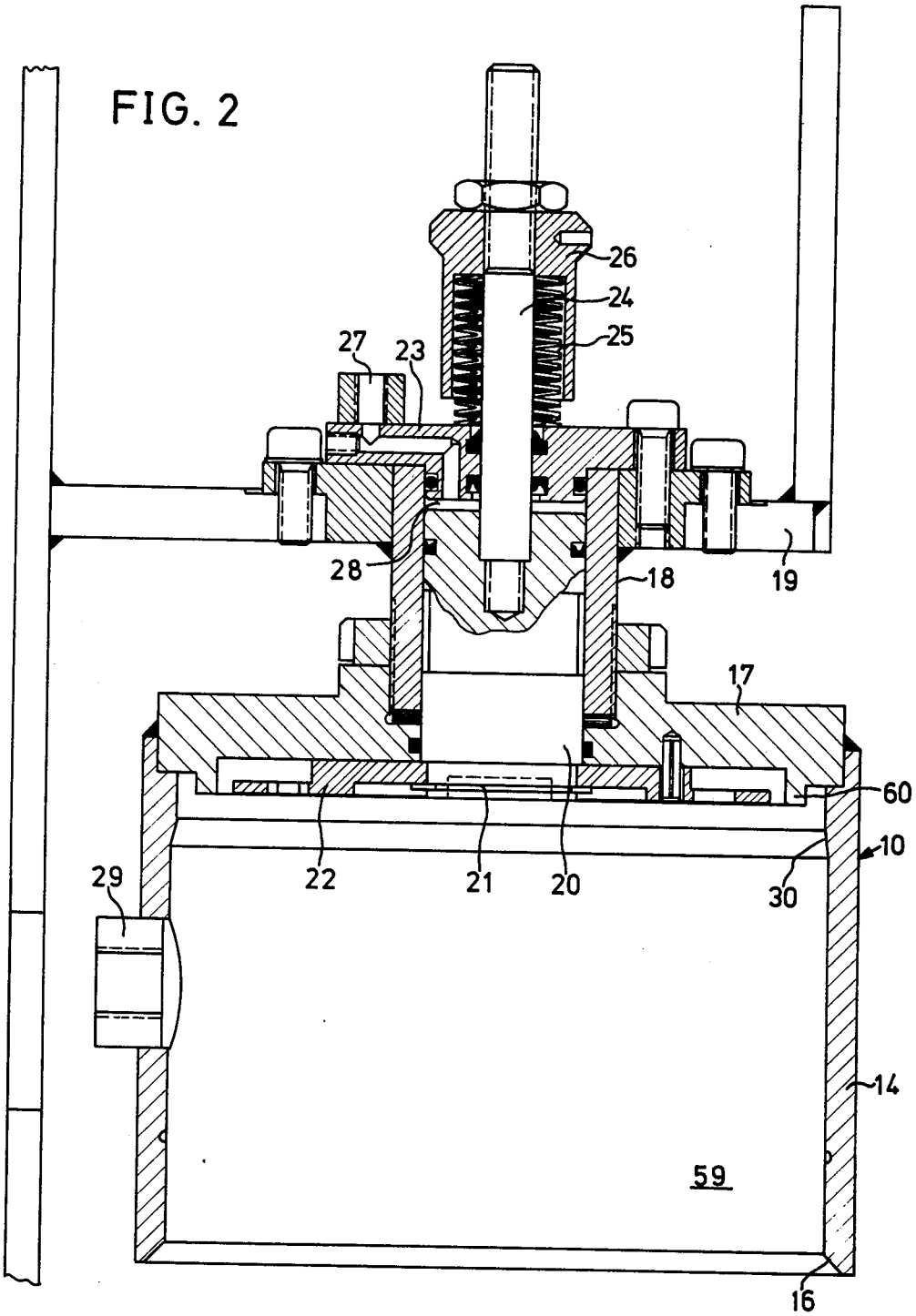
FIG. 2 shows the air evacuation chamber of the apparatus seen in FIG. 1.
Figure 3:
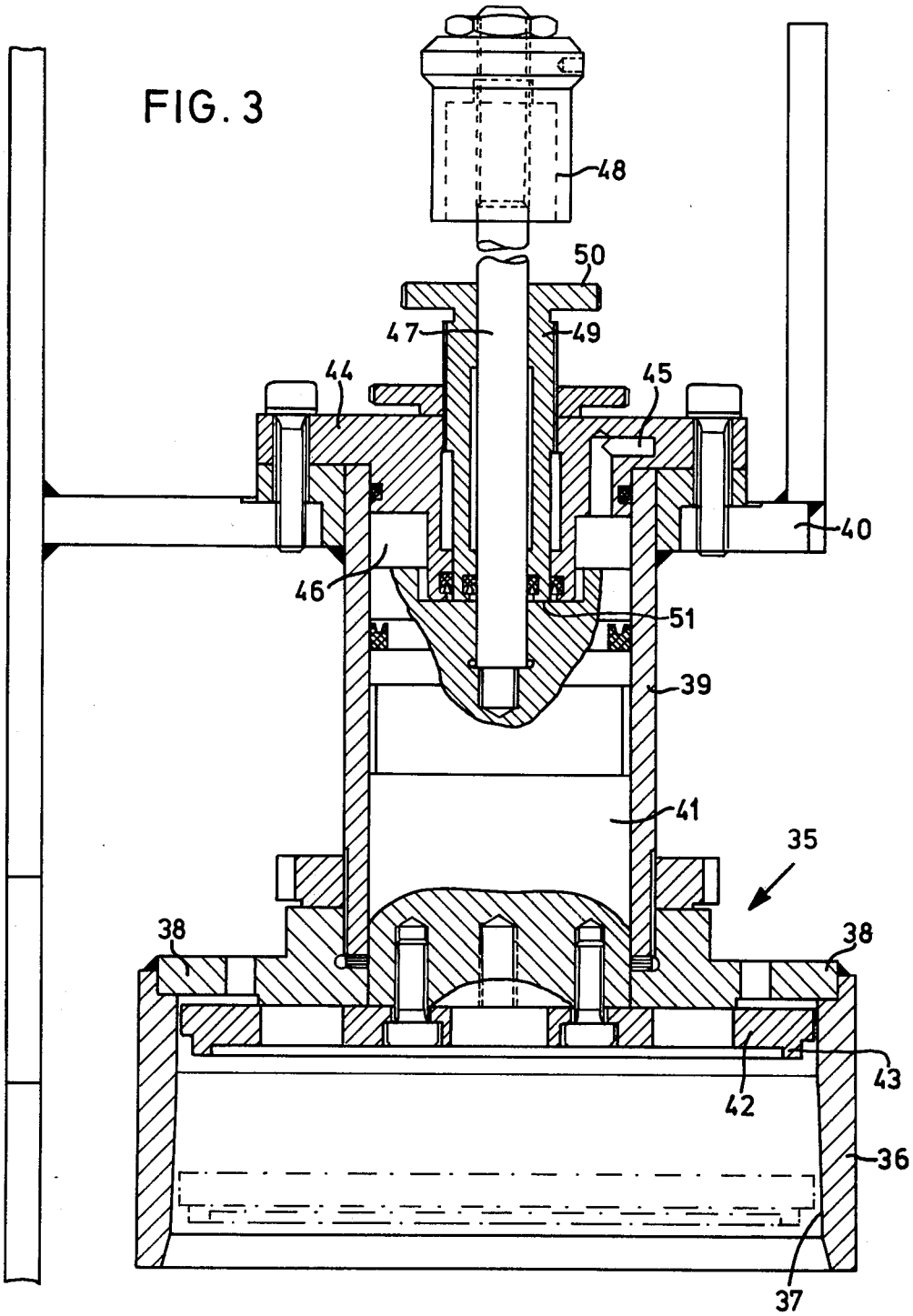
FIG. 3 shows a sealing unit of the apparatus seen in FIG. 1.
Figure 4:
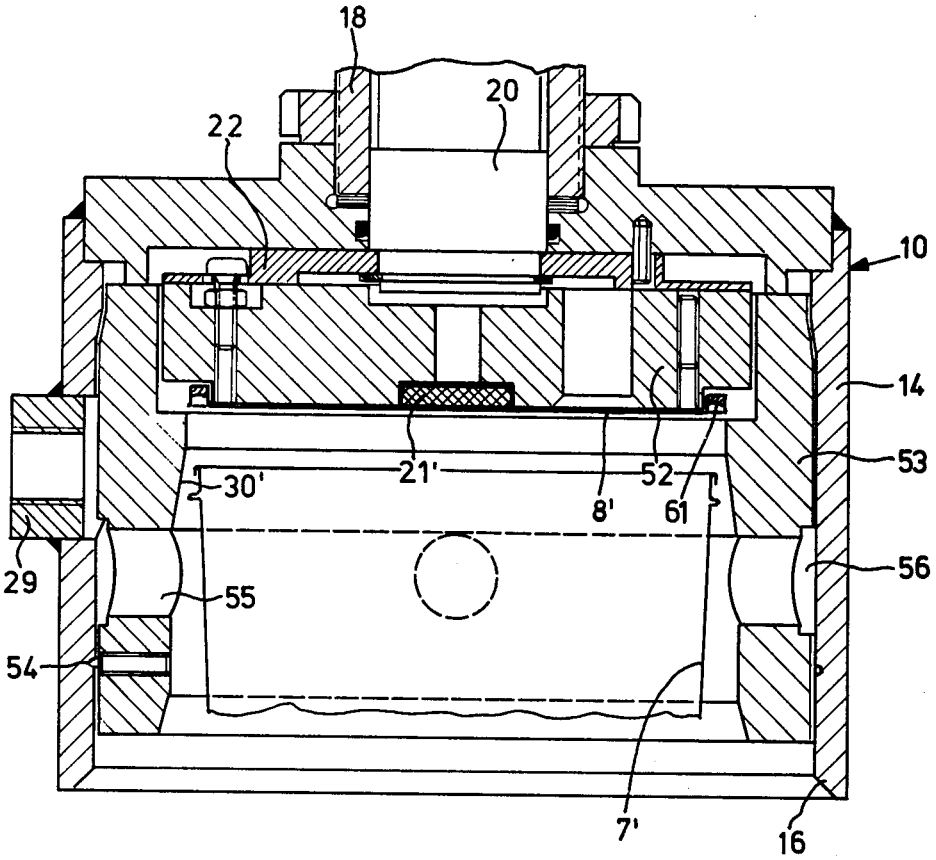
FIG. 4 shows an evacuation chamber corresponding to that of FIG. 2 and having reduction elements inserted.
Figure 5:
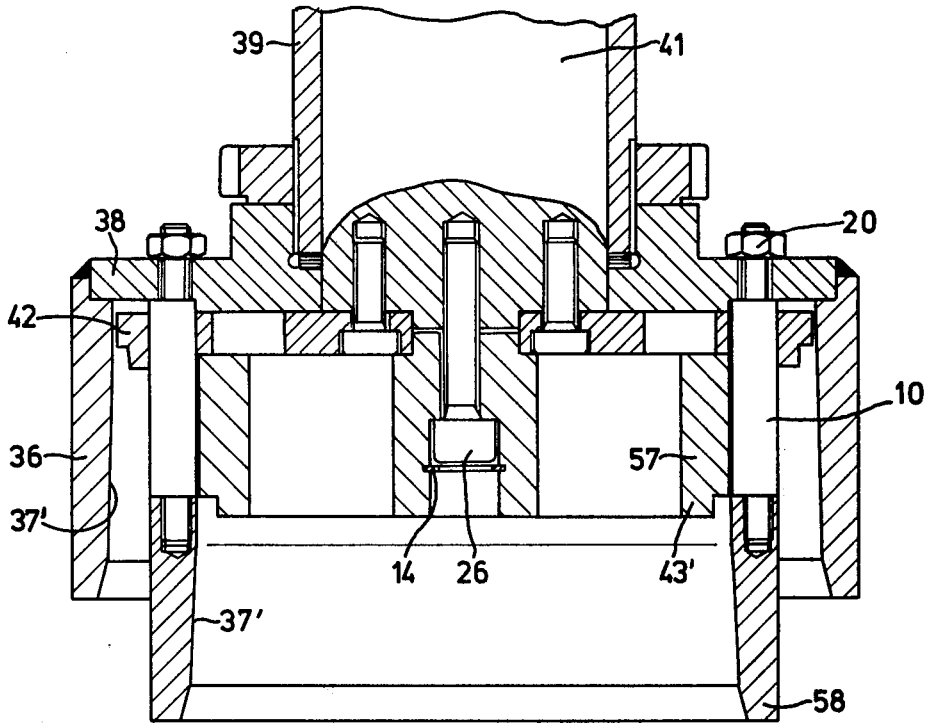
FIG. 5 shows a sealing unit corresponding to that of FIG. 3 and having elements inserted.

The present invention as shown in FIG. 1, has air evacuation station 1 and a sealing station 2. These stations 1, 2 are located on identical stands 3, 4 disposed immediately adjacent one to the other. A conveyor path 5 is provided which begins before entering air evacuation station 1 and travels in direction 6 through station 1 and through the subsequent sealing station 2 carrying cans 7 before and after completion of the functions of stations 1 and 2. On conveyor path 5, cans 7 are conveyed in cycles by means of conveyor devices not shown in detail and are delivered to the stations 1, 2. In the evacuation station 1 shown in FIG. 1, two evacuation chambers of the type disclosed in FIG. 2 or 4 are mounted, and two sealing units of the type disclosed in FIG. 3 or 5 are mounted in the sealing station 2, so that two cans 7 can be evacuated and sealed at one time. The cans 7 to be used here are, for example, similar to those shown in the German Offenlegungsschrift No. 2,263,362. Cans 7, having been previously filled and having a lid 8 placed loosely upon them, are delivered in cycles first to the evacuation station 1 and then to the sealing station 2. Each evacuation device comprises, in general terms, one lifting device 9 and one evacuation chamber 10. Each lifting device 9 comprises one pneumatically chargeable lifting cylinder 11, mounted on the stand 3 below the conveyor path 5, with a lifting plate 13 secured to the piston rod 12 which extends upward out of the lifting cylinder 11. In the final retracted position of lifting plate 13 seen on the right-hand side of FIG. 1, the lifting plate 13 is horizontally aligned with the conveyor path 5, so that a can 7 can be pushed onto it without further steps being necessary. The evacuation chamber 10 is located above the lifting device 9 and coaxially therewith. It has an approximately cylindrical bell 14 open at the bottom which is sealable in a gas-tight manner at the bottom by means of the lifting plate 13 when the latter is in its uppermost final position. In order to assume a gas-tight seal, the lifting plate 13 is provided with a ring seal 15 on its outer circumference, designed to press against a corresponding sealing surface 16 on the lower rim of the bell 14. The final extended position of the lifting plate 13 is shown in FIG. 1 in cooperation with the evacuation device on the left-hand side of the evacuation station.

At its top, as shown in FIG. 2, the bell 14 is closed off by an annular cover plate 17 attached in a gas-tight manner, by means of welding, for example. An adjustment cylinder 18 is screwed coaxially on the cover plate 17. This adjustment cylinder, in turn, is mounted on horizontal plate 19 of stand 3.

An adjustment piston 20, as shown in FIG. 2, is mounted in coaxial displacement with respect to the evacuation device, within the adjustment cylinder 18. The adjustment piston 20 carries a concentrically disposed permanent magnet 21 at its lower end and adjacent thereto a holder ring 22. Above adjustment piston 20, the adjustment cylinder 18 is sealed by means of a cylinder sealing cap 23 screwed on from the top and sealed. A retraction rod 24 extends in a sealed manner through the sealing cap 23 and is screwed into the adjustment piston 20 at its lower end. The retraction rod 24 is encircled by plate springs 25 which rest on the upper side of the cylinder sealing cap 23. A stop 26 open at the bottom is screwed to the upper end of retraction rod 24 thereby enabling adjustment of the initial stress of springs 25. A channel 27 for the delivery or withdrawal of pressure medium, which is generally compressed air, passes through the cylinder sealing cap 23 and discharges into a working chamber 28 of the adjustment cylinder 18 between the cylinder sealing cap 23 and the adjustment piston 20. The bell 14 is provided with a connection 29 for the purpose of evacuating the evacuation chamber 10 and refilling it with gas. In the upper part, the inner wall of the bell 14 is provided with a centering surface 30 which slopes conically inward toward the top.

Each sealing device as shown in FIG. 1 has a lifting device 34 comprising a pneumatically chargeable lifting cylinder 31 disposed on stand 4 below the conveyor path 5. A lifting plate 33 identical to the lifting plate 13 is mounted on the upper end of piston 32 of lifting device 34. A sealing unit 35, as part of the sealing device, is disposed coaxially with lifting device 34. The sealing unit 35 has a sealing bell 36 open at the bottom, which has a frustoconical pressure contact surface 37 tapering inward toward the top. The sealing bell 36 which is closed at the top by a conveyor 38 is also attached to horizontal plate 40 of the stand 4 via a coaxially disposed sleeve acting as the adjustment cylinder 39. An adjustment piston 41 shown in FIG. 3 with a stop ring 42 threaded on its lower end is disposed in the adjustment cylinder 39. This stop ring 42 has an annular centering shoulder 43 on its lower side near its outer circumference.

This adjustment cylinder 39 is sealed at the top by a screwed-on cylinder sealing cap 44. A channel 45 penetrates cap 44 for the delivery or outflow of a pressure medium, such as compressed air, into a working chamber 46 of the adjustment cylinder 39 between the upper side of the adjustment piston 41 and the lower side of the cylinder sealing cap 44.

A limitation rod 47 penetrating the working chamber 46 and the cylinder sealing cap 44 is screwed into the upper side of the adjustment piston 41 and is provided on its outside end with a cup-shaped stop 48 adjustable in length on limitation rod 47. Facing stop 48 is stop sleeve 49 screwed into and penetrating the cylinder sealing cap 44 which has a stop surface 50 adjacent to the stop 48. The upper portion of piston 41 carries the opposing limitation surface 51. By screwing the stop sleeve 49 to an appropriate extent into or out of the cylinder sealing cap 44, the uppermost position of the adjustment piston 41 is set. The lowermost final position of the adjustment piston 41 is set by the appropriate threading of the stop 48 on the limitation rod 47.

As may be seen from FIG. 4, in order to convert to can 7′ of lesser height in the evacuation chamber, a reduction element 52 can be screwed onto the underside of the holder ring 22 of the evacuation chamber 10, with a permanent magnet 21′ concentrically disposed on the underside of the reduction element 52. Additionally, in order to adapt to cans 7′ of smaller diameter, an approximately cylindrical reduction element 53 can be introduced into the bell 14 and releasingly locked to the bell 14 by means of yielding ball-like locks 54. This reduction element 53 also has a centering surface 30′ narrowing in conical fashion toward the top disposed in the portion of the reduction element 53 adjacent to the underside of the reduction element 52. It is also provided with gas evacuation openings 55, which communicate via an annular channel 56 turned into the outside surface of the reduction element 53 with the connection 29.

It may be seen in FIG. 5 that for the purpose of adaptation to the cans 7' of lesser height and smaller diameter in the sealing unit, a reduction ring 57 is threaded on the stop ring 42, extending it uniformly at the bottom. Furthermore, a reduction sealing bell 58 is screwed onto the underside of the cover plate 38 which also has a pressure contact surface 37' narrowing toward the top in conical fashion. The reduction ring 57 is also provided on its underside with a centering shoulder 43'.

The apparatus functions as follows:

Two filled cans 7 with a loosely placed lid 8 on top are moved into the air evacuation station 1 and moved onto the two lifting plates of the lifting devices 9. The lifting cylinders 11 are subjected to compressed air, in response to which the piston rod 12 together with the lifting plate 13 and the can 7 resting upon it moves toward until the lifting plate 13 engages bell 14, with a simultaneous sealing of the vacuum chamber 59 in the bell 14. During the enclosure of chamber 59 compressed air is emitted to chamber 28. The lifting distance traveled by the lifting cylinder 11 with the piston rod 12 is adjusted to be somewhat greater than the height of the can 7. The lifting distance is thus relatively great. On the other hand, the lifting force required is relatively small. For this reason, the lifting cylinder 11 may be relatively slender. Final sealing does not occur within chamber 59.

When the can 7 provided with a lid 8 travels into the vacuum chamber 59 of the evacuation chamber 10, the adjustment piston 20 with the holder ring 22 and the permanent magnet 21 is in its lowermost position which is determined by the contact of the cup-shaped stop 26 with the upper side of the cylinder sealing cap 23. Piston 20 has attained this position by emitting compressed air into working chamber 28 through channel 27. When chamber 28 is relieved, the adjustment piston 20 is brought by springs 25 into its uppermost final position. The lid 8, which is held by the permanent magnet 21, now rests against a centering rim 60 on the underside of the cover plate 17. The lid 8 and the can 7 have already been centered by surface 30 during movement into the vacuum chamber 59. After the vacuum chamber 59 is evacuated via the connection 29, a protective gas is introduced into the vacuum chamber 59 through connection 29, but not up to atmospheric pressure.

When the working chamber 28 is again subjected to compressed air, the adjustment piston 20 with the lid 8 is driven downward onto the can 7, into a pressure contact between sealing means 61 located on the cap rim and the upper rim of the can 7. At this time, the vacuum chamber 59 is filled entirely with air, resulting in lid 8 being pressed on solely as a result of the difference in pressure between the pressure in the can and atmospheric pressure. The lifting plate 13 with the can 7, now tightly closed as a result of atmospheric pressure, is moved downward. Subsequently the two cans 7, sealed simultaneously in the two evacuation chambers in the manner described, are brought into the sealing station 2 and placed upon the two lifting plates 33 of the lifting devices 34. Here, the lifting cylinders 31 are now subjected to compressed air so that the cans are pushed upward into the sealing bells 36. The rim of each lid 8 is now pressed (crimped) onto the can 7 by being moved along the pressure contact surface 37 which narrows in conical fashion toward the top, and as a result the can 7 is sealed fully. The stop ring 42, during this displacement movement, rests against the lid 8 and centers the lid by means of the centering shoulder 43, so that a uniform, centered pressure is exerted against the rim of the lid 8. This sealing movement is ended when the adjustment piston 41 drives against the limitation surface 51 of the stop sleeve 49. Now the working chamber 46 is subjected via the channel 45 to compressed air, as a result of which the adjustment piston 41 is pressed downward and the sealed can 7 is pressed out of the sealing bell 36. The bell 36 then travels downward again on the lifting plate 33.

As may also be seen in the drawing, the lifting distance required by the lifting plate 33 in the sealing station 2 are relatively small; on the other hand, the forces which are to be exerted by the lifting device 34 are relatively great. For this reason, the lifting cylinders 31 are relatively wide and compact. This means that the lifting cylinder 11 on the one hand and the lifting cylinder 31 on the other hand may be subjected to compressed air having the same pressure and because of the differing lifting distances they can perform their strokes each in approximately the same amount of time, but at different lifting velocities.

When the reduction elements 52 and 53 are inserted into the evacuation chamber 10 and the reduction ring 57 and the reduction sealing bell 58 are inserted into the sealing unit 35, in order to seal cans of lesser height and smaller diameter, then the course of the individual operational steps is the same as that described above.

It is further noted that upon opening the evacuation chamber 10 after the evacuation and filling with gas, the can 7 with the lid 8 remains on the lifting plate 13. That is, lid 8 is pulled away from the permanent magnet 21, because magnet 21 is not strong enough to support the weight of the filled can and because lid 8 is seated firmly on the can 7 because of pressure differences between the sealed can and external atmospheric pressure.

The reduction element 52 and the reduction ring 57 have a vertical extension which corresponds exactly to the difference between the height of a larger can 7 and a smaller can 7', so that the lifting distances of the lifting plates 13 and 33 do not need to be changed even in the case of a conversion of the apparatus to cans of different sizes.

It is to be appreciated that other embodiments and variants can be provided without departing from the spirit and scope of the invention, its scope being defined in the appended claims.

What is claimed is:

1. In an apparatus for sealing a can having a lid, under vacuum, including a vacuum station comprising a plate on which the can may be received, a stationary, evacuable bell, lifting means for lifting said plate, from below, against said bell, and lid lifting means for lifting the lid from the can, the improvement wherein said lid lifting means comprises an adjustment cylinder and an adjustment piston capable of being subjected to pressure medium and guided in said adjustment cylinder, and wherein the apparatus further includes reduction elements capable of being applied to said adjustment piston and to the inner wall of said bell, thereby permitting sealing of cans of varying sizes.

2. An apparatus in accordance with claim 1 further including a sealing station comprising a lifting plate, a stationary sealing bell having a pressure contact surface therein tapering inwardly toward the top, second lifting means for lifting said lifting plate, from below, against said sealing bell, a second adjustment cylinder and a second adjustment piston guided within said cylinder and serving as a counterpart holding means and pressing-out means, the apparatus further comprising a reduction sealing bell having a pressure contact surface therein tapering inwardly toward the top, said reduction sealing bell being capable of being releasably applied to said sealing bell, and a reduction ring capable of being releasably applied to said adjustment piston.

3. An apparatus in accordance with claim 2 wherein the adjustment distance of said second adjustment piston within said bell is adjustably settable.

4. An apparatus in accordance with claim 2, wherein both said second adjustment piston and said reduction ring have a stop ring thereon, each said stop ring having a centering shoulder for the lid provided thereon.

5. An apparatus in accordance with claim 1 wherein both said evacuatable bell and said associated reduction elements have a centering surface provided on the inner wall thereof.

* * * * *